US005549295A

United States Patent [19]

Goldring

[11] Patent Number: 5,549,295

[45] Date of Patent: Aug. 27, 1996

[54] MULTI-LEVEL ROTATABLE CONCENTRIC RING MARBLE GAME

[76] Inventor: Michael W. Goldring, 314 Quincy St., Brooklyn, N.Y. 11216

[21] Appl. No.: 528,618

[22] Filed: Sep. 15, 1995

[51] Int. Cl.[6] ..... A63F 7/00

[52] U.S. Cl. ..... 273/123 R; 273/118 R; 273/109; 273/113; 273/115

[58] Field of Search ..... 273/108, 109, 273/113, 115, 118, 123

[56] References Cited

U.S. PATENT DOCUMENTS

| | | | |
|---|---|---|---|
| 2,655,380 | 10/1953 | Engle | 273/123 R |
| 3,026,111 | 3/1962 | Licitis et al. | 273/118 R |
| 3,460,833 | 8/1969 | Killoren . | |
| 3,877,702 | 4/1975 | Saliger . | |
| 4,713,038 | 12/1987 | Wichman et al. . | |
| 5,201,524 | 4/1993 | Csanady et al. . | |
| 5,494,292 | 2/1996 | Mileti | 273/113 X |

*Primary Examiner*—Raleigh W. Chiu

*Attorney, Agent, or Firm*—Richard L., P.E. Miller

[57] ABSTRACT

A multi-level rotatable concentric ring marble game that includes a circular base, a circular upper peripheral cylinder, a lower peripheral cylinder, a cylindrical collector, and a plurality of concentric rotatable circular rings. The circular base contains a base central opening and has a base perimeter, a base flat bottom, and a base sloping top that slopes from the base perimeter towards the base central opening. The circular upper peripheral cylinder contains a plurality of upper peripheral cylinder openings and is disposed on the base sloping top at the base perimeter. The circular lower peripheral cylinder is disposed on the base flat bottom at the base perimeter. The cylindrical collector is rotatably mounted in the base central opening. Each of the a plurality of concentric rotatable circular rings contains a plurality of ring spaces and are rotatable mounted on the base sloping top intermediate the base perimeter and the cylindrical collector so that at least one of the plurality of ring spaces contained in each of the plurality of rotatable rings can be aligned with at least one of the plurality of ring spaces contained in each of the plurality of rotatable rings positioned adjacent thereto.

18 Claims, 2 Drawing Sheets

FIG. 4
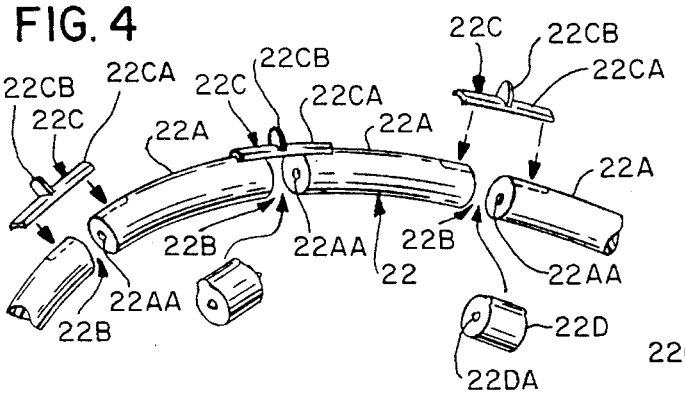
FIG. 5
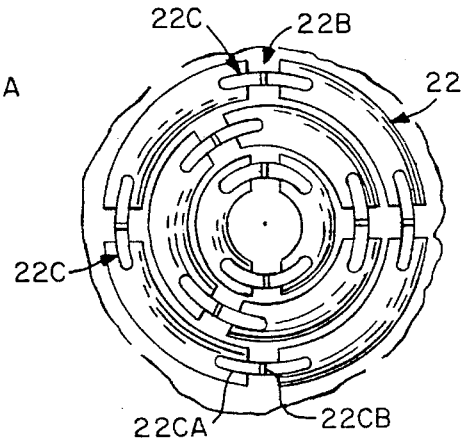
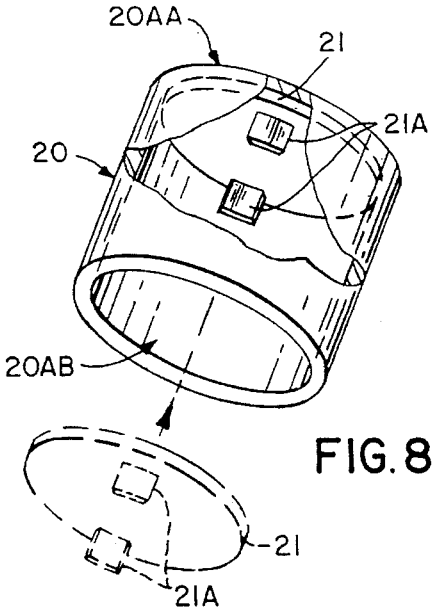
FIG. 8
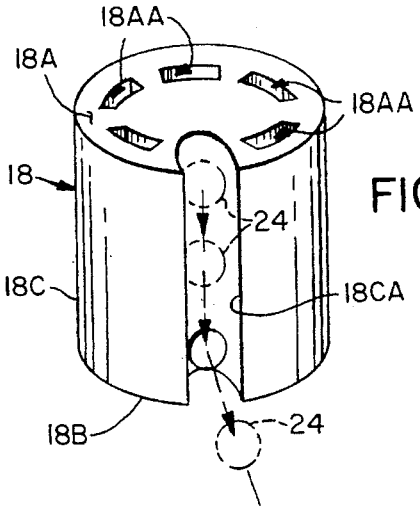
FIG. 7
FIG. 9
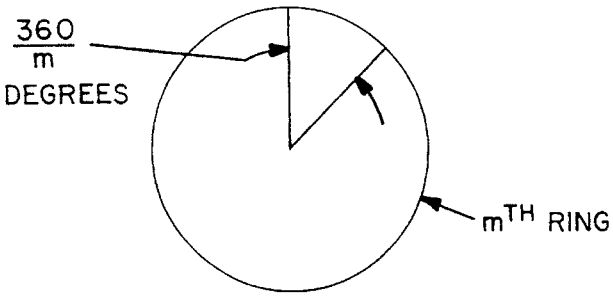
FIG. 6
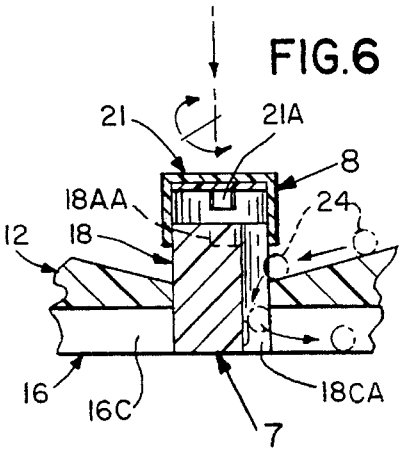

MULTI-LEVEL ROTATABLE CONCENTRIC RING MARBLE GAME

BACKGROUND OF THE INVENTION

The present invention relates to a marble game. More particularly, the present invention relates to a marble game utilizing multi-level rotatable concentric rings.

Numerous innovations for marble games have been provided in the prior art that will be described. However, even though these innovations may be suitable for the specific individual purposes to which they address, they differ from the present invention in that they do not provide a marble game utilizing multi-level concentric rings.

For example, U.S. Pat. No. 3,460,833 to Killoren teaches a marble game that has a plurality of inclined surfaces whereby marbles may be rolled towards pins spaced a distance slightly greater than the diameter of the marbles and forming bumpers for the marbles. Pockets for retaining the marbles have a pin located midway between two of the bumper pins and are displaced from the bumper pins one-half the diameter of the marbles in the direction of motion of the marbles. Channels are provided at the end of the inclined surfaces for delivery of missed marbles to a position adjacent the next playing position.

Another example, U.S. Pat. No. 3,877,702 to Saliger teaches a marble game including a base that supports a circular playing surface having an upstanding peripheral cylinder. Pockets are alternately and equally disposed about the rim. Troughs beneath the playing surface extend from the pockets to a collector. A marble size separator extends towards the peripheral rim from the collector a connects to a pair of discharge chutes each of which extend through a depending portion of the peripheral rim that masks the troughs collector, and separator.

Another example, U.S. Pat. No. 4,713,038 to Wichman et al. teaches a marble game that includes a number of different, interconnected marble race toys so that a marble passes from the exit of one to the entrance of another, downstream race toy.

Finally, an example, U.S. Pat. No. 5,201,524 to Csanady et al. teaches a marble game including a stationary top board having a plurality of spaced apart holes to define a game path. A rotatable bottom board includes a plurality of randomly spaced apart sink holes for aligning with the game holes. An angularly downward ramp surface guides the marble to a retrieval location.

It is apparent that numerous innovations for marble games have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide a multi-level rotatable concentric ring marble game that avoids the disadvantages of the prior art.

Another object of the present invention is to provide a multi-level rotatable concentric ring marble game that is simple and inexpensive to manufacture.

Still another object of the present invention is to provide a multi-level rotatable concentric ring marble game that is simple to use.

Yet another object of the present invention is to provide a multi-level rotatable concentric ring marble game that includes a circular base, a circular upper peripheral cylinder, a lower peripheral cylinder, a cylindrical collector, and a plurality of concentric rotatable circular rings.

Still yet another object of the present invention is to provide a multi-level rotatable concentric ring marble game wherein the circular base contains a base central opening and has a base perimeter, a base flat bottom, and a base sloping top that slopes from the base perimeter towards the base central opening.

Yet still another object of the present invention is to provide a multi-level rotatable concentric ring marble game wherein the circular upper peripheral cylinder contains a plurality of upper peripheral cylinder openings and is disposed on the base sloping top at the base perimeter.

Still yet another object of the present invention is to provide a multi-level rotatable concentric ring marble game wherein the circular lower peripheral cylinder is disposed on the base flat bottom at the base perimeter.

Yet still another object of the present invention is to provide a multi-level rotatable concentric ring marble game wherein the cylindrical collector is rotatably mounted in the base central opening.

Still yet another object of the present invention is to provide a multi-level rotatable concentric ring marble game wherein each of the a plurality of concentric rotatable circular rings contains a plurality of ring spaces and are rotatable mounted on the base sloping top intermediate the base perimeter and the cylindrical collector so that at least one of the plurality of ring spaces contained in each of the plurality of rotatable rings can be aligned with at least one of the plurality of ring spaces contained in each of the plurality of rotatable rings positioned adjacent thereto.

Yet still another object of the present invention is to provide a multi-level rotatable concentric ring marble game wherein the plurality of upper peripheral cylinder openings open onto the base sloping top.

Still yet another object of the present invention is to provide a multi-level rotatable concentric ring marble game wherein the cylindrical collector has a collector closed top that contains a plurality of top slots, a collector closed bottom, and a collector outer surface that contains a collector single outer surface recess.

Yet still another object of the present invention is to provide a multi-level rotatable concentric ring marble game wherein the collector single outer surface recess extends along the longitudinal direction of the collector from the collector closed bottom to the collector closed top intermediate a pair of the plurality of top slots.

Still yet another object of the present invention is to provide a multi-level rotatable concentric ring marble game wherein the collector extends passed the circular base inclined upper surface.

Yet still another object of the present invention is to provide a multi-level rotatable concentric ring marble game that further includes a hollow cylindrical collector cover that has a hollow body with a hollow body closed top and a hollow body open bottom.

Still yet another object of the present invention is to provide a multi-level rotatable concentric ring marble game wherein the collector cover is removably mounted to the collector so that the collector single outer surface recess is masked.

Yet still another object of the present invention is to provide a multi-level rotatable concentric ring marble game that further includes a disc shaped insert that is permanently insertable within the collector cover and has a pair of insert projections that extend downwardly therefrom.

Still yet another object of the present invention is to provide a multi-level rotatable concentric ring marble game wherein each of the pair of insert projections has a size that is smaller than the size of each of the plurality of top slots so that slack can be provided when the collector cover is rotated relative to the collector.

Yet still another object of the present invention is to provide a multi-level rotatable concentric ring marble game wherein the plurality of ring spaces of each of the plurality of rings define a plurality of ring sections that are of equal length and equally spaced.

Still yet another object of the present invention is to provide a multi-level rotatable concentric ring marble game wherein each of the plurality of ring sections have a pair of ring section ends that contain a ring section recess.

Yet still another object of the present invention is to provide a multi-level rotatable concentric ring marble game that further includes a plurality of bridge fingers each of which bridging a ring space of the plurality of ring spaces, Still yet another object of the present invention is to provide a multi-level rotatable concentric ring marble game wherein each of the plurality of ring bridge fingers has a ring bridge span part and a ring bridge grip part that extends upwardly from the ring bridge span part so that a user of the multi-level rotatable concentric ring marble game can readily rotate the plurality of concentric rotatable circular rings.

Yet still another object of the present invention is to provide a multi-level rotatable concentric ring marble game that further includes at least one ring insert that is removably insertable into at least one of the plurality of ring spaces so that the number of open ring spaces of the plurality of ring spaces can be varied.

Still yet another object of the present invention is to provide a multi-level rotatable concentric ring marble game wherein each of the at least one ring insert has a pair of insert ends that have extending therefrom an insert projection that is receivable by the ring section recesses.

Yet still another object of the present invention is to provide a multi-level rotatable concentric ring marble game wherein the at least one ring insert is manufactured from a yielding material.

Still yet another object of the present invention is to provide a multi-level rotatable concentric ring marble game wherein the circular base and the plurality of rings are manufactured from a hard plastic and are coated with a slippery coat to reduce friction.

Yet still another object of the present invention is to provide a multi-level rotatable concentric ring marble game wherein the plurality of rings are manufactured from a substantially non-yielding transparent material.

Still yet another object of the present invention is to provide a multi-level rotatable concentric ring marble game wherein the circular upper peripheral cylinder, the circular lower peripheral cylinder, the collector, and the collector cover are manufactured from a hard plastic.

Yet still another object of the present invention is to provide a multi-level rotatable concentric ring marble game wherein the upper peripheral cylinder openings are equally spaced and are equal in number to the number of the plurality of rotatable circular rings plus one.

Finally, an object of the present invention is to provide a method of playing a multi-level rotatable concentric marble game that includes the steps of choosing a plurality of differently designed competitive marbles and a plurality of clear neutral marbles, preparing a list ranking the plurality of competitive marbles so that each of the plurality of competitive marbles is given a number on the list, placing the plurality of competitive marbles in a bag, picking by each player the same number of competitive marbles, positioning the player having the highest ranked marble anywhere around the multi-level rotatable concentric ring game, positioning the player having the next highest ranked marble to the left of the highest ranked player, positioning the remaining players to the left of the previously ranked player, rotating an outermost ring until a plurality of ring section slots contained therein align with a plurality of upper peripheral cylinder apertures, rotating remaining rings until a plurality of ring section slots contained in one ring do not align with a plurality of ring section slots contained in an adjacent ring, inserting the competitive marbles by each player through the plurality of upper peripheral cylinder apertures so that the competitive marbles rest in the plurality of ring section slots in the outermost ring, inserting the plurality of neutral marbles into any void contained in the plurality of ring section slots of the outermost ring so that the plurality of ring section slots in the outer most ring are filled, rotating the outermost ring by the highest ranked player until all his competitive marble pass from the outermost ring into an adjacent ring, rotating the remaining rings by the remaining players until one of the competitive marbles enters a ring section slot contained in an inner most ring, removing a collector cover from a collector by the player whose marble first entered the inner most ring so that the location of a collector recess contained in the collector can be determined, rotating the innermost ring until a ring section slot is in alignment with the collector recess and the marble enters the collector recess and passes into a lower peripheral cylinder open space and become readably removably when the multi-level rotatable concentric ring marble game is lifted from a playing surface, and determining the winner.

The novel features which are considered characteristic of the present invention are set forth in the appended claims. The invention itself, however, both as to its construction and method of operation, together with additional objects and advantages thereof, will be best understood from the following description of the specific embodiments when read and understood in connection with the accompanying drawing.

BRIEF DESCRIPTION OF THE DRAWING

FIG. 4 is an enlarged diagrammatic partial perspective view of the slide rings with the bridging fingers exploded therefrom for clarity, with optional inserts;

FIG. 5 is an enlarged diagrammatic plan view with parts broken away taken in the direction of arrow 5 in FIG. 3;

FIG. 6 is an enlarged diagrammatic cross sectional view with parts broken away taken in the area of the dotted curve indicated by arrow 6 in FIG. 3 with the cover partially elevated;

FIG. 7 is an enlarged diagrammatic perspective view taken generally in the area of arrow 7 of FIG. 6 illustrating just the slotted rotatable center component per se;

FIG. 8 is an enlarged diagrammatic exploded view with parts broken away of the center component' shield per se; and FIG. 9 is a diagrammatic illustration showing the mathematical function relating the angle in degrees between bridging fingers for any nth ring.

LIST OF REFERENCE NUMERALS UTILIZED IN THE DRAWING

10—multi-level rotatable concentric ring marble game of the present invention

12—circular base

12A—circular base center aperture

12B—circular base outer periphery

12C—circular base flat lower surface

12D—circular base inclined upper surface

14—circular upper peripheral cylinder

14A—circular upper peripheral cylinder lower edge

14B—plurality of evenly spaced apertures

16—circular lower peripheral cylinder

16A—circular lower peripheral cylinder center aperture

16B—circular lower peripheral cylinder upper edge

16C—circular lower peripheral cylinder open space

18—cylindrical collector

18A—collector closed top

18AA—plurality of top slots

18B—collector closed bottom

18C—collector outer surface

18CA—outer surface recess

20—hollow cylindrical collector cover

20A—hollow body

20AA—hollow body closed top

20AB—hollow body open bottom

21—disc shaped insert

21A—pair of insert projections

22—plurality of concentric rotatable rings

22A—plurality of ring sections

22AA—ring section recess

22B—ring section slot

22C—ring bridge finger

22CA—ring bridge span part

22CB—ring bridge grip part

22D—ring insert

22DA—ring insert projection

24—marbles

DETAILED DESCRIPTION OF THE PREFERRED EMBODIMENT

Referring now to the figures in which like numerals indicate like parts, the multi-level rotatable concentric ring marble game of the present invention is shown generally at 10 and can be played by 2 to 16 people using marbles 24.

Figure 1:
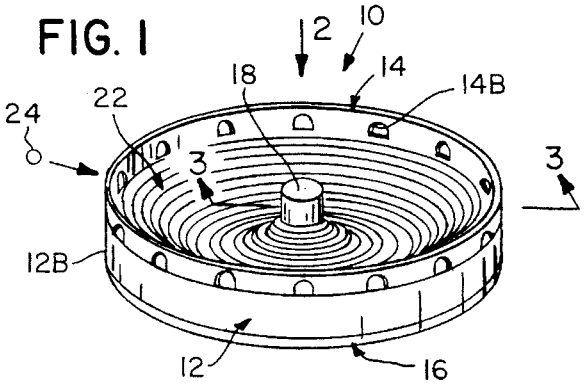
FIG. 1 is a diagrammatic perspective view of the instant invention with bridging finger grips removed for clarity.
Figure 3:
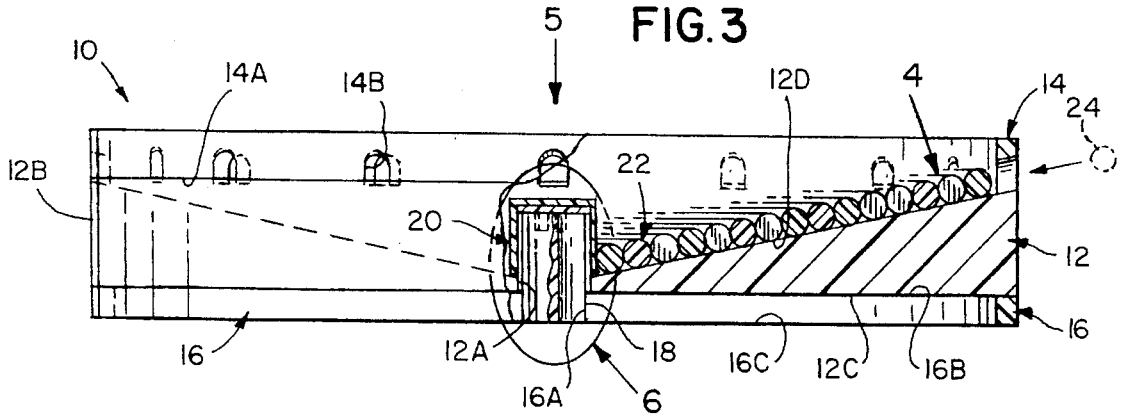
FIG. 3 is an enlarged diagrammatic partially cross sectioned view taken on line 3—3 of FIG. 1.
Figure 2:
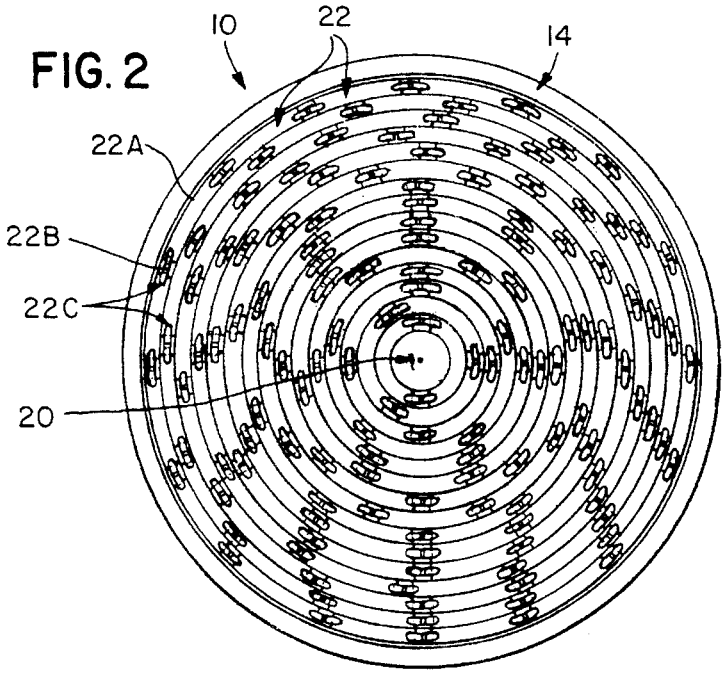
FIG. 2 is an enlarged plan view taken in the direction of arrow 2 in FIG. 1 but with the finger grips illustrated in place.

The general configuration of multi-level rotatable concentric ring marble game 10 can best be seen in FIGS. 1–3, and as such, will be discussed with reference thereto.

The multi-level rotatable concentric ring marble game 10 includes a circular base 12, a circular upper peripheral cylinder 14, a circular lower peripheral cylinder 16, a cylindrical collector 18, a hollow cylindrical collector cover 20 that fits snugly over the cylindrical collector 18, and a plurality of concentric rotatable circular rings 22.

The circular base 12 may be manufactured from a hard plastic and contains a circular base center aperture 12A, has a circular base outer periphery 12B, a flat circular base lower surface 12C, and an inclined circular base upper surface 12D that slopes from the circular base outer periphery 12B to the circular base center aperture 12A and can be coated with a slippery coat to reduce friction.

The circular upper peripheral cylinder 14 may be manufactured from a hard plastic and has a circular upper peripheral cylinder lower edge 14A into which a plurality of evenly spaced apertures 14B open. The number of the plurality of evenly spaced apertures 14B is equal to the number of the plurality of rotatable circular rings 18 plus one. The circular upper peripheral cylinder 14 is disposed above the circular base 12 with the circular upper peripheral cylinder lower edge 14A on t the inclined circular base portion upper surface 12D at the circular base portion outer periphery 12B.

Since the plurality of upper peripheral cylinder apertures 14B open into the circular upper peripheral cylinder lower edge 14A, and since the circular upper peripheral cylinder lower edge 14A is disposed on the inclined circular base upper surface 12D at the circular base outer periphery 12B, the plurality of upper peripheral cylinder apertures 14B are in direct communication with the inclined circular base upper surface 12D at the circular base outer periphery 12B.

The circular lower peripheral cylinder 16 may be manufactured from a hard plastic and contains a lower peripheral cylinder center aperture 16A, has a circular lower peripheral cylinder upper edge 16B, and contains a circular lower peripheral cylinder open space 16C which functions as a discharge chute. The circular lower peripheral cylinder 16 is disposed below the circular base 12 with the circular lower peripheral cylinder upper edge 16B in contact with the flat circular base portion lower surface 12C at the circular base portion outer periphery 12B. The lower peripheral cylinder center aperture 16A is in alignment with the circular base center aperture 12A.

The cylindrical collector 18 may be manufactured from a hard plastic and can be coated with a slippery coat to reduce friction is rotatably disposed within the aligned lower peripheral cylinder center aperture 16A and the circular base center aperture 12A and extends past the circular base inclined upper surface 12D.

The cylindrical hollow collector cap 20 that is removably mounted to and prevents access to the cylindrical collector 18, terminates on the circular base inclined upper surface 12D.

The plurality of concentric rotatable circular rings 22 may be manufactured from a hard plastic, be transparent, coated with a slippery coating to reduce friction, and are disposed on the inclined circular base upper surface 12D intermediate the circular upper peripheral cylinder 14 and the cylindrical collector 18.

The configuration of the plurality of concentric rotatable circular rings 22 can best be seen in FIGS. 2,4,5 and 9, and as such will be discussed with reference thereto.

Each of the plurality of concentric rotatable circular ring 22 are movable relative to each other in a nesting arrangement and includes a plurality of ring sections 22A that are independent of each other and are spaced an equal distance from each other. Each of the plurality of ring sections 22A are of equal length and are manufactured a substantially non-yielding material. The ends of each of the plurality of ring sections 22A contain a ring section recess 22AA. The space intermediate each of the plurality of ring sections 22A defines a ring section slot 22B which is bridged by a ring bridge finger 22C. The ring bridge finger 22C is affixed to the ring sections 22A and maintains the integrity of the concentric rotatable circular ring 22.

The ring bridge finger 22C includes a ring bridge span part 22CA and a ring bridge grip part 22CB. The ring bridge grip part 22CB provide a means by which the user of the multi-level rotatable concentric ring marble game 10 can readily rotate the plurality of concentric rotatable circular rings 22.

An optional cylinder insert 22D that is manufactured from a yielding material can be removably inserted into any of the ring slots 22B. The use of the ring inserts 22D customizes the rings 22 for the number of people playing and the number of marbles used. An insert projection 22DA is disposed on each end of each of the rings inserts 22D. When the ring insert 22D is used, the insert projections 22DA are removably received by the ring section recesses 22AA which secure the ring insert 22D within the ring slot 22B, making that respective ring slot 22B inoperative.

As can be seen in FIG. 9, the angle between the bridging fingers 22C for a respective ring 22 is equal to 360 degrees divided by the position number of the respective ring 22. In determining the position number of each respective ring 22, the collector 18 is considered the first. The concentric rotatable circular ring 22 closest to the collector 18 is the second, the concentric rotatable circular ring 22 next to the second concentric rotatable circular ring 22 is the third, and so forth.

For example, if one wanted to know the angle between the bridging fingers 22C of the respective ring 22 that is in the sixth position, one divides 360 degrees by six and yields an angle of 60 degrees.

The configuration of the cylindrical collector 18 can best be seen in FIGS. 6 and 7, and as such, will be discussed with reference thereto.

The cylindrical collector 18 has a collector closed top 18A that contains a plurality of top slots 18AA, a collector closed bottom 18B, and a collector outer surface 18C that contains a single outer surface recess 18CA that extends along the longitudinal direction of the collector 18 from the collector closed bottom 18B to the collector closed top 18A intermediate a pair of the plurality of top slots 18AA.

The configuration of the hollow cylindrical collector cover 20 can best be seen in FIGS. 6 and 8, and as such, will be discussed with reference thereto.

The hollow cylindrical collector cover 20 masks the location of the outer surface recess 18CA of the collector 18 and has a hollow body 20A with a hollow body closed top 20AA and a hollow body open bottom 20AB.

An optional disc shaped insert 21 has a pair of insert projections 21A extending downwardly therefrom. The size of each of the pair of insert projections 21A is smaller than the size of each of the plurality of top slots 18AA so that slack can be provided when the cover 20 is rotated relative to the collector 18.

The amount of concentric rotatable circular rings 22 is variable, but for the following discussion of the use of the multi-level rotatable concentric ring marble game 10, fifteen concentric rotatable circular rings 22 will be used which can be rotated clockwise or counterclockwise by the use of the ring bridge grip parts 22CB.

The marbles 24 have sixteen competitive marbles which can be colored and must be of different designs, and fourteen neutral marbles which can be clear. A list is prepared ranking the sixteen marbles one to sixteen so that each of the sixteen different competitive marbles is given a number on the list.

The sixteen competitive marbles are placed in a bag and the players each pick the same number of marbles and the player having the highest ranked marble positions himself anywhere around the multi-level rotatable concentric ring game 10. The fifteenth ring 22 is then configured so that the number of ring slots 22B that are to remain open is 4, 8, or 16. This number is deliberated on by the player and the agreed upon choice 4, 8, or 16 must be equal to or greater than the number of players times the number of marbles picked by each player. For example, if five players are playing and each player picks two marbles then number of ring slots 22B open in the fifteenth ring 22 is sixteen. Netural marbles are used to fill excess open slots 22B.

The player having the next highest ranked marble positions himself to the left of the highest ranked player and the remaining players position themselves to the left of the previously ranked player.

The fifteenth ring 22 is rotated until the ring section slots 22B align with the upper peripheral cylinder apertures 14B. The remaining fourteen rings 22 are then rotated until the ring section slots 22B of the ring 22 do not align with the ring section slots 22B of the adjacent ring 22.

Each player then inserts his competitive marbles through the plurality of upper peripheral cylinder apertures 14B so that the marbles rest in the ring section slots 22B of the fifteenth ring 22. If there are any ring section slots 22B in the fifteenth ring 22 that are void of the competitive marbles than these voids are filled with the neutral marbles so that every ring section slot 22B in the fifteenth ring 22 is filled.

The player with the highest ranked marble rotates the fifteenth ring 22 until all his marble 24 pass from the ring section slots 22B of the fifteenth ring 22 into the ring section slots 22B of the fourteenth ring 24. If all of the marbles of the first player can not pass into the fourteenth ring 22 by merely rotating the fifteenth ring 22 then the fourteenth ring 22 may be rotated accordingly. Subsequently, players continue to rotate the fifteen rings 22 that contain their marbles or an adjacent lower level ring 22 for any predetermined length of time so that their marbles pass through the ring section slots 22B of the rings 22. However, when a player rotates a specific ring 22 to move his marbles, the chance arises that his opponent's marbles will also pass through the ring section slots 22B in a favorably matter. The first player to rotate the first ring 22 removes the collector cover 20 so that the location of the collector recess 18CA can be determined. The first ring 22 is then moved so that the ring section slot 22B is in alignment with the collector recess 18CA and the marble enters the collector recess 18CA. The marbles that enter the recess 18CA pass into the lower peripheral cylinder open space 16C and become readably removed when the multi-level rotatable concentric ring marble game 10 is lifted from the playing surface.

The multi-level rotatable concentric ring marble game 10 can be played in two ways. The player having no marbles visible on the fifteen rings 22 is the winner or the player having the last marble visible on the fifteen rings 22 is the winner.

It will be understood that each of the elements described above, two or more together, may also find a useful application in other typed of constructions differing from the typed described above.

While the invention has been illustrated and described as embodied in a multi-level rotatable concentric ring marble game, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed as new and desired to be protected by Letters Patent is set forth in the appended claims.

The invention claimed is:

1. A multi-level rotatable concentric ring marble game, comprising:

a) a circular base containing a base central opening and having a base perimeter, a base flat bottom, and a base sloping top that slopes from said base perimeter towards said base central opening;

b) a circular upper peripheral cylinder containing a plurality of upper peripheral cylinder openings and being disposed on said base sloping top at said base perimeter;

c) a circular lower peripheral cylinder being disposed on said base flat bottom at said base perimeter;

d) a cylindrical collector rotatably mounted in said base central opening; and e) a plurality of concentric rotatable circular rings each of which containing a plurality of ring spaces and being rotatable mounted on said base sloping top intermediate said base perimeter and said cylindrical collector so that at least one of said plurality of ring spaces contained in said each of said plurality of rotatable rings can be aligned with said at least one of said plurality of ring spaces contained in said each of said plurality of rotatable rings positioned adjacent thereto.

2. The game as defined in claim 1, wherein said plurality of upper peripheral cylinder openings open onto said base sloping top.

3. The game as defined in claim 2, wherein said cylindrical collector has a collector closed top that contains a plurality of top slots, a collector closed bottom, and a collector outer surface that contains a collector single outer surface recess, said collector single outer surface recess extends along the longitudinal direction of said collector from said collector closed bottom to said collector closed top intermediate a pair of said plurality of top slots, said collector extends passed said circular base inclined upper surface.

4. The game as defined in claim 3; further comprising a hollow cylindrical collector cover that has a hollow body with a hollow body closed top and a hollow body open bottom, said collector cover is removably mounted to said collector so that said collector single outer surface recess is masked.

5. The game as defined in claim 4, further comprising a disc shaped insert that is permanently insertable within said collector cover and has a pair of insert projections that extend downwardly therefrom.

6. The game as defined in claim 5, wherein each of said pair of insert projections has a size that is smaller than the size of each of said plurality of top slots so that slack can be provided when said collector cover is rotated relative to said collector.

7. The game as defined in claim 1, wherein said plurality of ring spaces of each of said plurality of rings define a plurality of ring sections that are of equal length and equally spaced.

8. The game as defined in claim 7, wherein each of said plurality of ring sections have a pair of ring section ends that contain a ring section recess.

9. The game as defined in claim 8; further comprising a plurality of bridge fingers each of which bridging a ring space of said plurality of ring spaces.

10. The game as defined in claim 9, wherein each of said plurality of ring bridge fingers has a ring bridge span part and a ring bridge grip part that extends upwardly from said ring bridge span part so that a user of said multi-level rotatable concentric ring marble game can readily rotate said plurality of concentric rotatable circular rings.

11. The game as defined in claim 10; further comprising at least one ring insert that is removably insertable into at least one of said plurality of ring spaces so that the number of open ring spaces of said plurality of ring spaces can be varied.

12. The game as defined in claim 11, wherein each of said at least one ring insert has a pair of insert ends that have extending therefrom an insert projection that is receivable by said ring section recesses.

13. The game as defined in claim 12, wherein said at least one ring insert is manufactured from a yielding material.

14. The game as defined in claim 1, wherein said circular base and said plurality of rings are manufactured from a hard plastic and are coated with a slippery coat to reduce friction.

15. The game as defined in claim 9, wherein said plurality of ring sections and bridge fingers are manufactured from a substantially non-yielding transparent material.

16. The game as defined in claim 1, wherein said circular upper peripheral cylinder, said circular lower peripheral cylinder, said collector, and said collector cover are manufactured from a hard plastic.

17. The game as defined in claim 1, wherein said upper peripheral cylinder openings are equally spaced and are equal in number to the number of said plurality of rotatable circular rings plus one.

18. A method of playing a multi-level rotatable concentric marble game, comprising the steps of:

a) choosing a plurality of differently designed competitive marbles and a plurality of clear neutral marbles;

b) preparing a list ranking said plurality of competitive marbles so that each of said plurality of competitive marbles is given a number on said list;

c) placing said plurality of competitive marbles in a bag;

d) picking by each player the same number of said plurality of competitive marbles;

e) positioning said player having the highest ranked marble anywhere around said multi-level rotatable concentric ring game;

f) positioning said player having the next highest ranked marble to the left of said highest ranked player;

g) positioning the remaining players to the left of the previously ranked player;

h) rotating an outermost ring until a plurality of ring section slots contained therein align with a plurality of upper peripheral cylinder apertures;

i) rotating remaining rings until a plurality of ring section slots contained in one ring do not align with a plurality of ring section slots contained in an adjacent ring;

j) inserting said plurality of competitive marbles by each player through said plurality of upper peripheral cylinder apertures so that said competitive marbles rest in said plurality of ring section slots in said outermost ring;

k) inserting said plurality of neutral marbles into any void contained in said plurality of ring section slots of said outermost ring so that said plurality of ring section slots in said outer most ring are filled;

l) rotating said outermost ring by said highest ranked player until all his competitive marble pass from said outermost ring into an adjacent ring;

m) rotating said remaining rings by said remaining players until a first of said plurality of competitive marbles enters a ring section slot contained in an inner most ring;

n) removing a collector cover from a collector by the player whose marble first enters said inner most ring so that the location of a collector recess contained in said collector can be determined;

o) rotating said innermost ring until a ring section slot is in alignment with said collector recess and said marble enters said collector recess and passes into a lower peripheral cylinder open space and become readably removed when said multi-level rotatable concentric ring marble game is lifted from a playing surface; and q) determining the winner.

* * * * *